US006961975B2

(12) United States Patent
Park et al.

(10) Patent No.: US 6,961,975 B2
(45) Date of Patent: Nov. 8, 2005

(54) CONVERTIBLE VACUUM CLEANER

(75) Inventors: Jung-seon Park, Gwangju (KR); Byung-jo Lee, Gwangju (KR); Hyung-il Jeon, Gwangju (KR)

(73) Assignee: Samsung Gwangju Electronics Co., Ltd., Gwangju (KR)

( * ) Notice: Subject to any disclaimer, the term of this patent is extended or adjusted under 35 U.S.C. 154(b) by 378 days.

(21) Appl. No.: 10/294,364

(22) Filed: Nov. 14, 2002

(65) Prior Publication Data

US 2004/0049879 A1 Mar. 18, 2004

(30) Foreign Application Priority Data

Sep. 12, 2002 (KR) ..... 10-2002-0055318

(51) Int. Cl.[7] ..... A47L 9/22
(52) U.S. Cl. ..... 15/329; 15/331; 15/338
(58) Field of Search ..... 15/328, 331, 329, 15/338, 327.5, 410

(56) References Cited

U.S. PATENT DOCUMENTS 4,928,346 A * 5/1990 Elson et al. ..... 15/338
5,007,133 A 4/1991 Lackner et al. ..... 15/351
5,309,600 A * 5/1994 Weaver et al. ..... 15/328
5,524,321 A * 6/1996 Weaver et al. ..... 15/329
5,715,566 A * 2/1998 Weaver et al. ..... 15/327.5
6,058,559 A * 5/2000 Yoshimi et al. ..... 15/328
6,094,775 A * 8/2000 Behmer ..... 15/329
6,779,229 B2 * 8/2004 Lee et al. ..... 15/329
6,839,934 B2 * 1/2005 Houghton et al. ..... 15/329

FOREIGN PATENT DOCUMENTS

EP 1190660 3/2002

* cited by examiner

*Primary Examiner*—Theresa T. Snider
(74) *Attorney, Agent, or Firm*—Ladas & Parry LLP

(57) ABSTRACT

A convertible vacuum cleaner has a nozzle comprising a suction port; a cleaner body having a filter housing in which a filter is mounted, and a motor housing in which a motor is mounted, the cleaner body for being removably connected with the nozzle, the suction port being connected with the filter when the cleaner body is connected with the nozzle; a locking member slidably disposed on a side of the nozzle; a slot formed in the motor housing for receiving the locking member and thereby preventing the cleaner body from separating from the nozzle; and a unlocking means for sliding out the locking member from the slot. By sliding the locking member, which is slidably disposed in the nozzle, into or out from the slot of the cleaner body, the nozzle and the cleaner body can be connected or disconnected simply.

9 Claims, 5 Drawing Sheets

CONVERTIBLE VACUUM CLEANER

BACKGROUND OF THE INVENTION

1. Field of the Invention

The present invention generally relates to a vacuum cleaner, and more particularly, it relates to a convertible vacuum cleaner between a canister type and an upright type.

2. Description of the Prior Art

Generally, a vacuum cleaner draws in dust or foreign substances from the surface by the vacuum pressure generated in a vacuum motor of the cleaner body. Vacuum cleaners, such as canister type, upright type, stick type and handy type are currently available in the market.

In the canister type vacuum cleaner, a nozzle for drawing in foreign substances therethrough is connected to the cleaner body having a motor and a dust-collecting chamber through a flexible hose and/or extension pipe. Such canister type vacuum cleaner is very useful especially when cleaning stairs, closets or places with adjacent obstacles. The drawback of the canister type vacuum cleaner is derived from its characteristic that requires a cleaner operator to carry the cleaner body that is connected to the nozzle through the flexible hose. Accordingly, cleaning efficiency drops when the operator has to clean a relatively large area.

In the upright type vacuum cleaner, a nozzle provided with a rotary brush is directly connected to the cleaner body having a motor driving chamber and a dust-collecting chamber, and thus, it is useful for surfaces to be cleaned that have a large area, such as carpets and floors. However, the upright type vacuum cleaner is not that efficient for cleaning stairs or places having many obstacles, such as furniture.

Recently suggested was a convertible vacuum cleaner, which can be converted between the canister type and the upright type, in an attempt to overcome the shortcomings of each type of the vacuum cleaner. The convertible vacuum cleaner can be converted as the canister type or the upright type according to the requirements of the specific cleaning operation, and an example thereof can be found in the U.S. Pat. No. 5,524,321.

As shown in FIG. 1, a conventional convertible vacuum cleaner includes a foot housing 10 having a suction port and a rotary brush, and a module 20 removably connected to the foot housing 10. The module 20 includes a bag housing 21 and a motor housing 22. Mounted on the foot housing 10 to support the module 20 is a support member 13, to which a base support member 11 and a grip 12 are connected. The foot housing 10 also includes a foot lever 14 rotatably disposed on the foot housing 10 for lifting the module 20 from the foot housing 10.

The convertible vacuum cleaner constructed as above is converted into the upright type for the purpose of cleaning a relatively large area, such as a carpet or floor. To be converted into the upright type vacuum cleaner, the module 20 is mounted on the base support member 11. Accordingly, a recess (not shown) formed at a lower portion of the motor housing 22 is connected with a projection 16 formed on the base support member 11. The bag housing 21 is connected to the foot housing 10 through the flexible hose 23, and the foreign substances drawn in through the suction port of the foot housing 10 is collected in a filter bag of the bag housing 21 via the flexible hose 23.

For the purpose of cleaning relatively narrow places, or places having obstacles, such as furniture, on them, the module 20 is separated from the foot housing 10, and the convertible vacuum cleaner is converted into the canister type.

In order to lift the module 20 from the foot housing 10, the foot lever 14, provided on the upper portion of the foot housing 10, is used. When the module 20 and the foot housing 10 are connected with each other, the pedal portion 15 of the foot lever 14 protrudes outwardly, with one end of the foot lever 14 being positioned at the lower portion of the module 20. Accordingly, as the user steps on the pedal portion 15, the one end of the foot lever 14 is raised, lifting up the module 20 until the module 20 is separated from the base support member 11.

In the convertible vacuum cleaner having the above mounting and dismounting structure, when the foot lever 14 lifts up the lower side of the module 20 from the foot housing 10, the contacting portions between the foot lever 14 and the module 20, and between the recess of the motor housing 22 and the projection 16 of the base support member 11 tend to wear out because of the friction.

SUMMARY OF THE INVENTION

Accordingly, it is an object of the present invention to provide a convertible vacuum cleaner in which a cleaner body can be separated from a nozzle simply by using a pedal, and wear in connecting portion between the nozzle and the cleaner body is minimized.

The above object is accomplished by a convertible vacuum cleaner according to the present invention, including a nozzle comprising a suction port; a cleaner body comprising a filter housing in which a filter is mounted, and a motor housing in which a motor is mounted, the cleaner body being removably connected with the nozzle, the suction port being connected with the filter when the cleaner body is connected with the nozzle; a locking member slidably disposed on a side of the nozzle; a slot formed in the motor housing for receiving at least a portion of the locking member and thereby preventing the cleaner body from separating from the nozzle; and an unlocking means for sliding out the portion of locking member from the slot.

Further provided is a spring for biasing the locking member toward the slot.

The motor housing comprises a first protrusion formed at a side of the motor housing, the first protrusion having the slot formed therein. The locking member is shaped and adapted to slide into a seating groove formed in a supporting member that is rotatably disposed in the nozzle.

The unlocking means includes a pedal; an operation member integrally formed with the pedal at a predetermined angle; and a pivot formed on a connecting area between the pedal and the operation member, whereby the operation member is pivoted on the pivot to enable the portion of the locking member to slide out from the slot.

The seating groove is provided with a guiding protrusion, and the locking member is provided with a guiding groove for receiving the guiding protrusion.

The motor housing further comprises a second protrusion formed on a side for insertion into a second hole formed at the supporting member.

The supporting member comprises a bracket formed for rotatably supporting the lever.

BRIEF DESCRIPTION OF THE DRAWINGS

The above-mentioned objects and the feature of the present invention will be made more apparent by reference to the description below of the preferred embodiment of the present invention, in view of the appended drawings, in which.

DETAILED DESCRIPTION OF THE PREFERRED EMBODIMENT

Figure 1:
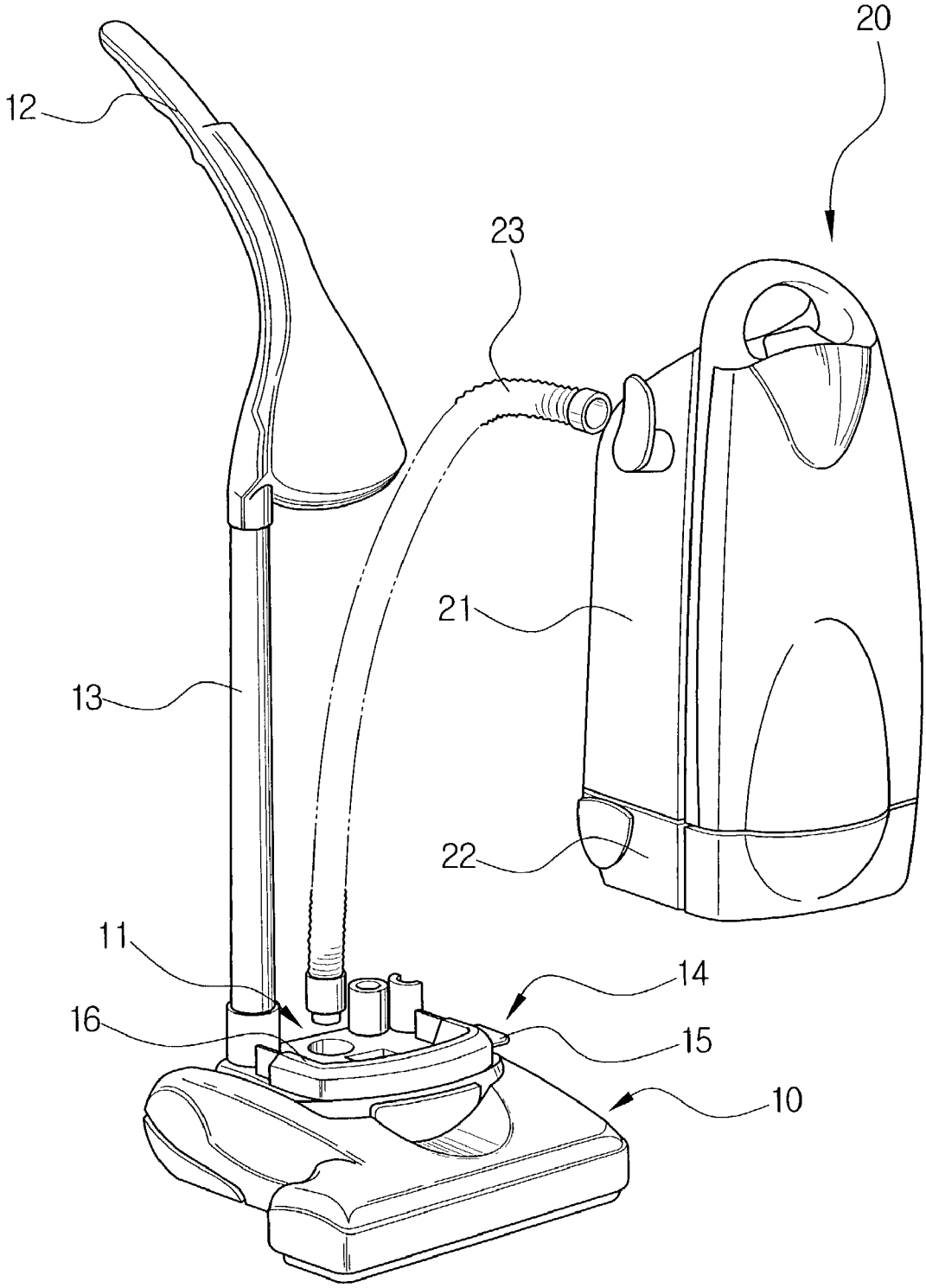
FIG. 1 (PRIOR ART)
FIG. 1 is a schematic perspective exploded view of a conventional convertible vacuum cleaner.
Figure 2:
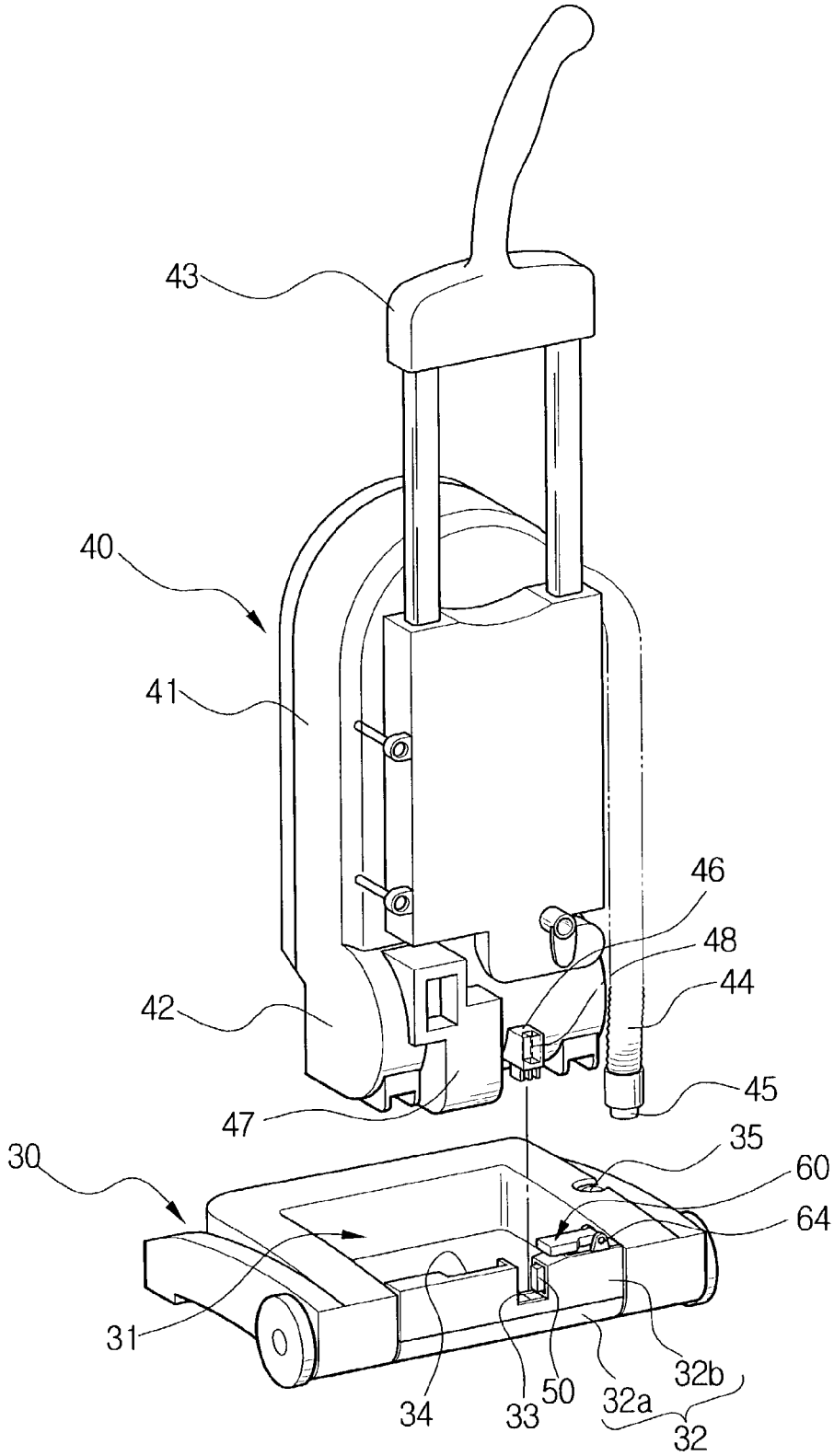
FIG. 2 is a perspective exploded view showing a nozzle and a cleaner body of a convertible vacuum cleaner according to a preferred embodiment of the present invention.
Figure 3:
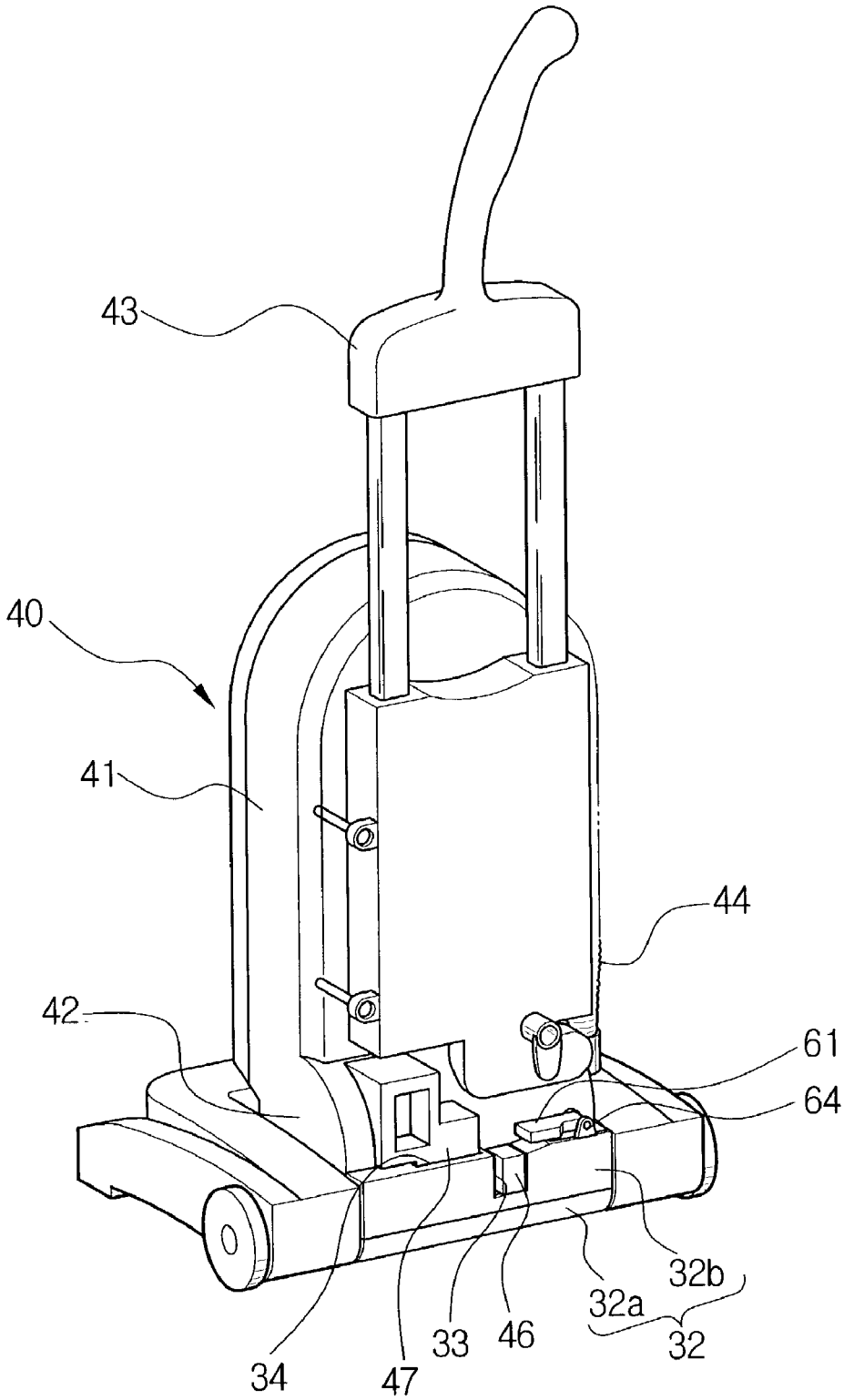
FIG. 3 is a perspective view showing the nozzle and the cleaner body of FIG. 2 being connected with each other.
Figure 4:
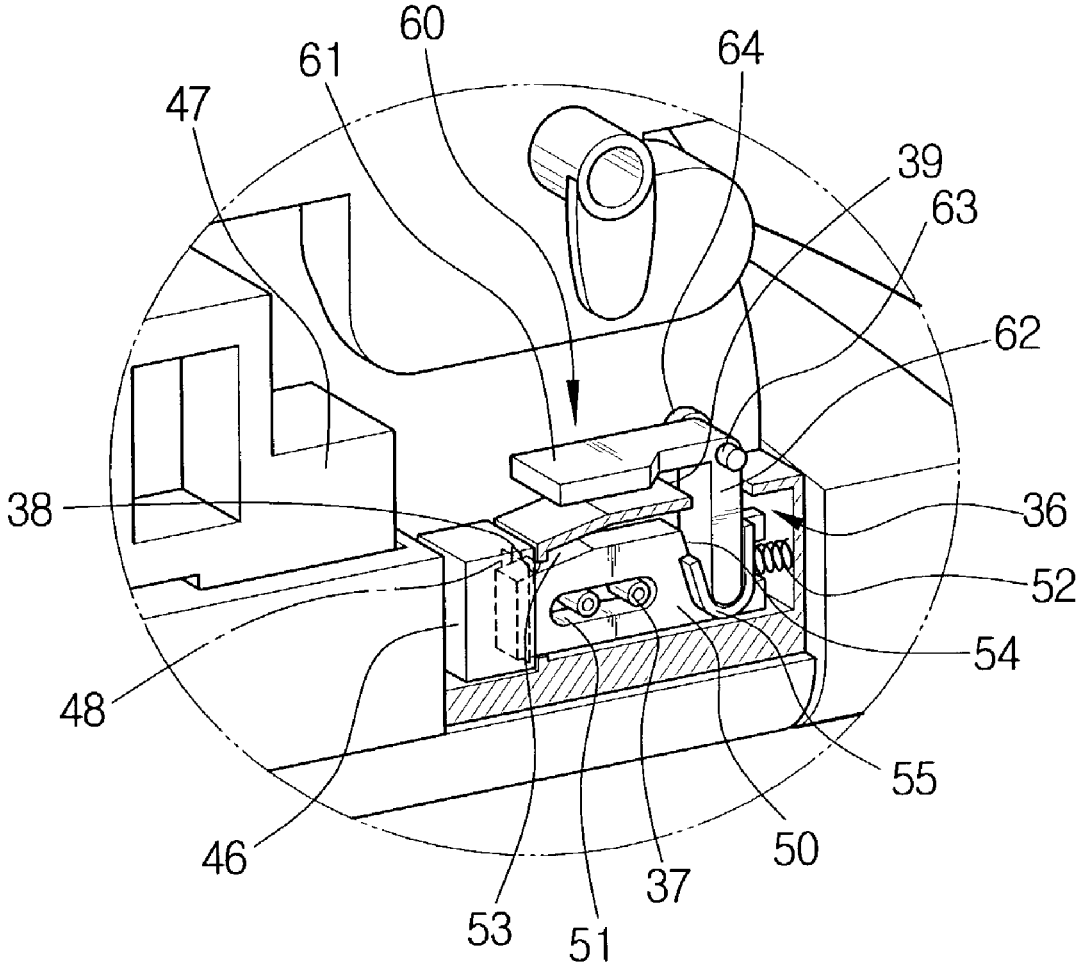
FIGS. 4 and 5 are detailed perspective views illustrating the operation of a locking member of FIG. 2.

The objects and other characteristics of the present invention will be made more apparent by describing the preferred embodiments with reference to the accompanying drawings.

As shown in FIGS. 2 through 5, the convertible vacuum cleaner according to the present invention includes a nozzle 30, a cleaner body 40, a locking member 50 and a lever 60.

The nozzle 30 is provided with a suction port (not shown) formed in the lower portion or underside for drawing in foreign substances from the surface to be cleaned, a rotary brush (not shown) for removing the foreign substances off from the surface to be cleaned, and a body seating portion 31 formed at the upper portion of the nozzle 30 on which the cleaner body 40 is seated. A supporting member 32 is also provided at an outer surface of the nozzle 30 for rotatably supporting the cleaner body 40. The supporting member 32 includes a supporting portion 32*a* rotatably disposed on the nozzle 30, and a connecting portion 32*b* for connecting to the cleaner body 40. The connecting portion 32*b* has first and second holes 33, 34 formed therein. Also provided at the side of the nozzle 30 is a connecting hole 35 in fluid communication with the suction port.

The cleaner body 40 has a filter housing 41 in which a filter is mounted, and a motor housing 42 in which a motor is mounted. A handle 43 is mounted on the upper portion of the filter housing 41, and a flexible hose 44 is disposed at, and preferably connected to, the outer side of the filter housing 41. The flexible hose 44 connects the filter with the suction port of the nozzle 30, and has a connecting port 45 formed and adapted for connecting with the connecting hole 35. The motor housing 42 has first and second protrusions 46, 47 formed on one side for insertion into the first and second holes 33, 34, respectively, of the connecting portion 32*b*. The first protrusion 46 has a slot 48 (shown in phantom) formed therein.

The locking member 50 is movably disposed in a seating hole 36 (FIG. 4) of the connecting portion 32*b* to be slid thereon. The locking member 50 has a guiding groove 51 (FIGS. 4 and 5), and a guiding protrusion 37 inserted in the guiding groove 51. With one end being connected with a spring 52, the other end of the locking member 50 is biased to protrude through the first hole 33 via a first opening 38. A slanted surface 53 is formed on the other end of the locking member 50 for enabling the locking member 50 to be smoothly inserted into the first hole 33 by the first protrusion 46, as shown.

Rotation of the lever 60 causes the locking member 50 to slide against the force of the spring 52 so that the other end of the locking member 50 can be slid out from the first hole 33. The lever 60 includes a pedal 61 and an operation member 62 connected to the pedal 61 in approximately a perpendicular relation with respect to the pedal 61. At the corner of the lever 60, where the pedal 61 and the operation member 62 are connected, a pivot 63 is disposed. The pivot 63 is rotatably supported on a bracket 64 that is formed on the upper portion of the connecting portion 32*b*. Accordingly, the lever 60 pivots on the pivot 63, and the pedal 61 becomes horizontal with respect to the surface to be cleaned, and the operation member 62 is inserted through the second opening 39 at the upper portion of the connecting portion 32*b* into the hole 54 formed in the locking member 50. Between the operation member 62 and the hole 54 of the locking member 50, a rubber plate 55 can be disposed to minimize wear in the operation member 62 and the locking member 50.

Hereinafter, the operation of the convertible vacuum cleaner according to the present invention will be described.

In the upright type vacuum cleaner, the cleaner body 40 is connected to the nozzle 30. The motor housing 42 is positioned on the seating portion 31 of the nozzle 30, and the first protrusion 46 is inserted into the first hole 33 of the connecting portion 32*b* and the second protrusion 47 is inserted into the second hole 34 of the connecting portion 32*b*. The other end of the locking member 50 is inserted into the slot 48 of the first protrusion 46, and the connecting port 45 of the flexible hose 44 is inserted into the connecting hole 35 of the nozzle 30.

When motor operation of the motor in the motor housing 42 commences, foreign substances from the surface to be cleaned are drawn in through the suction port of the nozzle 30, and collected in the filter of the filter housing 41 via the flexible hose 44. Since the cleaner body 40 is connected to the supporting member 32 that is rotatably disposed on the nozzle 30, the operator of the cleaner can move the nozzle 30 simply by adjusting the slope of the cleaner body 40 by altering the angle of the handle 43.

Figure 5:
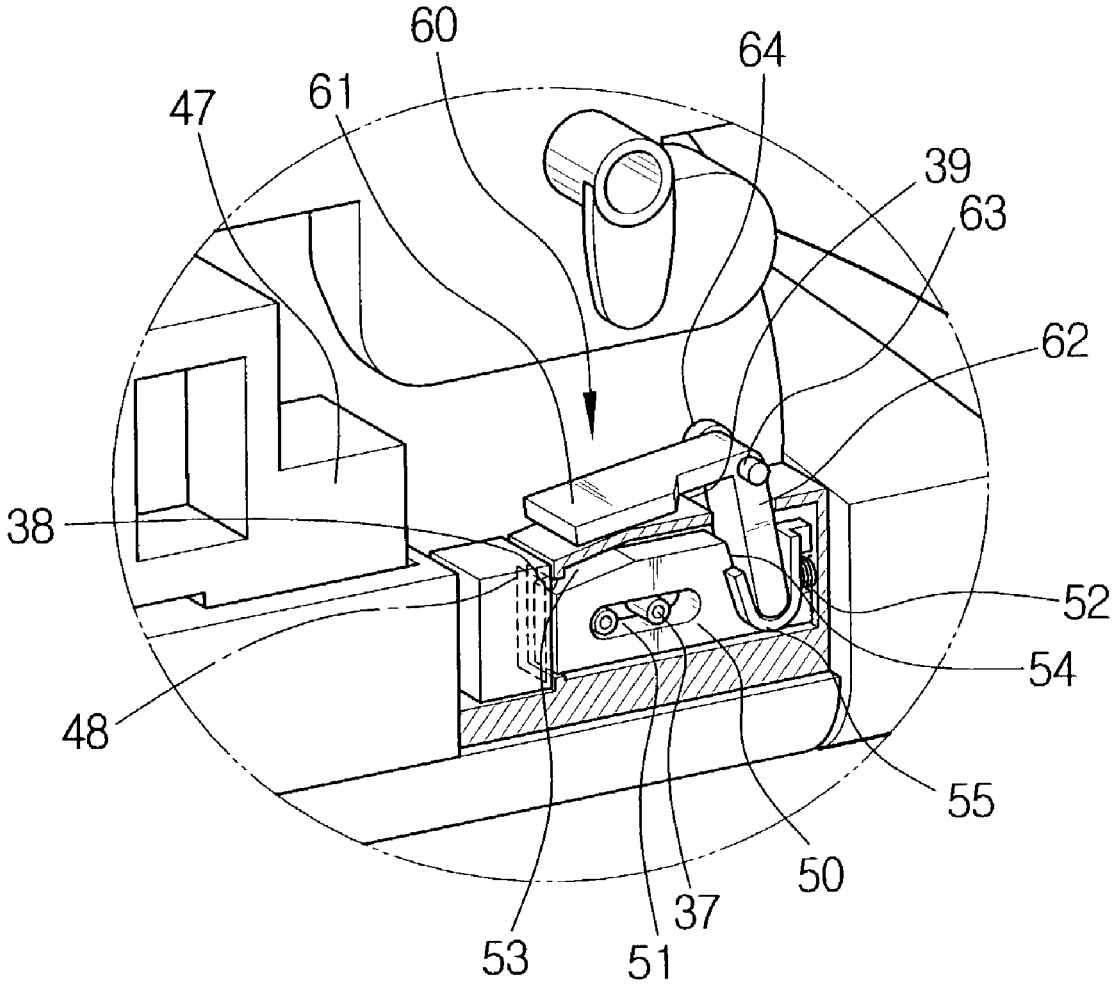

During use of the vacuum cleaner as a canister type vacuum cleaner, the cleaner body 40 is separated from the nozzle 30. In order to separate the cleaner body 40 from the nozzle 30, as shown in FIG. 5, the pedal 61 of the lever 60 is pushed down, and the operation member 62 is pivoted on the pivot 63. At the same time, the operation member 62 pushes the locking member 50 against the recovery force of the spring 52 so that the other end of the locking member 50 slides out from the slot 48 of the first protrusion 46 (shown in phantom), thereby unlocking the nozzle 30 from the cleaner body 40. Upon unlocking the nozzle 30 from the cleaner body 40, the cleaner body 40 is easily separated from the nozzle 30 by lifting up the cleaner body 40 in an upwardly direction. Accessories, such as secondary nozzle, are then connected to the connecting portion 45 for the cleaning operation.

According to the present invention, the operator of the cleaner operates the lever 60 with his/her hand or foot to slide the locking member, thereby to separate the cleaner body 40 from the nozzle 30 and thus, the nozzle 30 can be easily separated from the cleaner body 40.

Also, according to the present invention, the contacting area of respective parts are prevented from wear during the separation of the cleaner body 40 from the nozzle 30 by the lever 60.

Although the preferred embodiment of the present invention has been described, it will be understood by those skilled in the art that the present invention should not be limited to the described preferred embodiment, but various changes and modifications can be made while remaining within the spirit and scope of the present invention as defined by the appended claims and their equivalents.

What is claimed is:

1. A convertible vacuum cleaner, comprising:

a nozzle comprising a suction port;

a cleaner body comprising a filter housing in which a filter is mounted, and a motor housing in which a motor is mounted, the cleaner body for being removably connected with the nozzle, the suction port being connected with the filter when the cleaner body is connected with the nozzle;

a locking member slidably disposed on a side of the nozzle;

a slot formed in the motor housing for receiving at least a portion of the locking member and thereby preventing the cleaner body from separating from the nozzle; and an unlocking means for sliding out the portion of the locking member from the slot.

2. A convertible vacuum cleaner, comprising:

a nozzle comprising a suction port;

a cleaner body comprising a filter housing in which a filter is mounted, and a motor housing in which a motor is mounted, the cleaner body for being removably connected with the nozzle, the suction port being connected with the filter when the cleaner body is connected with the nozzle;

a locking member slidably disposed on a side of the nozzle;

a slot formed in the motor housing for receiving at least a portion of the locking member and thereby preventing the cleaner body from separating from the nozzle; and an unlocking means for sliding out the portion of the locking member from the slot, wherein the motor housing comprises a first protrusion formed at a side of the motor housing, the first protrusion having the slot formed therein.

3. The convertible vacuum cleaner of claim 2, further comprising a spring for biasing the locking member toward the slot.

4. The convertible vacuum cleaner of claim 2, wherein the locking member is shaped and adapted to slide into a seating groove formed in a supporting member that is rotatably disposed in the nozzle.

5. The convertible vacuum cleaner of claim 4, wherein the seating groove is provided with a guiding protrusion, and the locking member is provided with a guiding groove for receiving the guiding protrusion.

6. The convertible vacuum cleaner of claim 4, wherein the motor housing further comprises a second protrusion formed on a side for insertion into a second hole formed at the supporting member.

7. The convertible vacuum cleaner of claim 5, wherein the supporting member comprises a bracket for rotatably supporting a lever.

8. The convertible vacuum cleaner of claim 2, wherein the unlocking means comprises:

a pedal;

an operation member integrally formed with the pedal at a predetermined angle; and a pivot formed on a connecting area between the pedal and the operation member, whereby the operation member is pivoted on the pivot to enable the portion of the locking member to slide out from the slot.

9. The convertible vacuum cleaner of claim 8, wherein the operation member is inserted in the hole formed in the locking member and the locking member further comprises a rubber plate disposed between the operation member and the hole of the locking member.

* * * * *